US008051619B2

(12) United States Patent
Hohmann, Jr.

(10) Patent No.: US 8,051,619 B2
(45) Date of Patent: Nov. 8, 2011

(54) REINFORCING SPACER DEVICE

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 219 days.

(21) Appl. No.: 12/258,879

(22) Filed: Oct. 27, 2008

(65) Prior Publication Data

US 2010/0101166 A1 Apr. 29, 2010

(51) Int. Cl.
*E04C 5/16* (2006.01)

(52) U.S. Cl. ..... 52/677; 52/649.8

(58) Field of Classification Search ..... 52/432, 52/677, 649.8, 379, 565, 513, 687
See application file for complete search history.

(56) References Cited

U.S. PATENT DOCUMENTS

| | | | | | |
|---|---|---|---|---|---|
| 903,000 | A | | 11/1908 | Priest | |
| 2,124,799 | A | * | 7/1938 | Specht | 52/308 |
| 2,172,816 | A | | 9/1939 | Douglas et al. | |
| 2,300,181 | A | | 10/1942 | Spaight | |
| 3,183,628 | A | | 5/1965 | Smith | |
| 3,964,226 | A | | 6/1976 | Hala et al. | |
| 4,334,397 | A | | 6/1982 | Hitz | |
| 4,689,931 | A | | 9/1987 | Hodges | |
| 4,793,104 | A | * | 12/1988 | Hultberg et al. | 52/127.3 |
| 5,193,320 | A | * | 3/1993 | Coccagna | 52/442 |
| 5,259,161 | A | * | 11/1993 | Carter | 52/127.3 |
| 5,351,457 | A | | 10/1994 | Colen | |
| 5,454,200 | A | | 10/1995 | Hohmann et al. | |
| 6,279,283 | B1 | | 8/2001 | Hohmann et al. | |
| 6,553,737 | B1 | | 4/2003 | Berg | |
| 6,629,393 | B2 | | 10/2003 | Pignataro | |

* cited by examiner

*Primary Examiner* — Basil Katcheves
*Assistant Examiner* — Branon Painter
(74) *Attorney, Agent, or Firm* — Senniger Powers LLP

(57) ABSTRACT

A reinforcing and spacing device is described for use in a masonry wall structure of successive courses of brick, block, stone or other similar masonry material. The reinforcing spacer device includes parallel side rods with interconnecting intermediate rods and spacing nodes disposed on the side rods and the intermediate rods. The embedment of the reinforcing spacer device in the horizontal and vertical mortar joints of a masonry wall structure provides simultaneous reinforcement of the horizontal mortar joint and uniform spacing of the brick, block, stone or other similar masonry material. The reinforcing spacer device is a labor-saving, combination device that is economical to manufacture and allows for proper positioning and strengthening of a masonry wall structure.

4 Claims, 9 Drawing Sheets

REINFORCING SPACER DEVICE

BACKGROUND OF THE INVENTION

1. Field of the Invention

This invention relates to a reinforcing spacer device for use in the horizontal and vertical mortar of masonry walls. More particularly, this invention relates to a device combining reinforcement and spacing between adjacent masonry units.

2. Description of the Prior Art

Masonry, the building of structures from individual units laid in and bound together by mortar, is commonly used for the construction of buildings. Such widespread use is the result of the high durability, compressive strength, thermal mass and heat resistance of the masonry building materials. Because masonry construction requires extensive manual labor and individual building materials such as brick or block, the quality of the masonry construction is directly dependent on the type of materials used and the workmanship of the mason.

In the past, the construction of structurally sound, high quality wall units constructed of brick, block, stone or similar masonry building units has depended upon the workmanship of masons. The pattern used in setting the building materials strongly effects the durability of the overall construction. Through extensive training, masons develop techniques for evenly applying mortar to bed joints and vertical joints between units so that the units are evenly spaced in each course and the wall face remains vertical.

In recent years attention has been paid to wall reinforcement especially for areas that are routinely subjected to seismic forces. Here both wire reinforcements and ladder and truss reinforcements have been in widespread use. Such reinforcements are embedded in the horizontal mortar joints to reinforce, bond and control shrinkage cracking. Additionally, the reinforcements provide higher resistance to lateral loads, such as wind, by increasing tensile strength.

The inventors' patents and their assignee's product line include masonry accessories, namely, ladder and truss reinforcements, wall anchors, veneer ties, masonry flashing and related items for cavity walls. These products, which are sold under the trademarks of Lox All, DW-10X, X-seal and Flex-Flash, are manufactured by Hohmann & Barnard, Inc., Hauppauge, N.Y. 11788 ("H&B"). The products have become widely accepted in the construction industry and the inventors have gained particular insight into the technological needs of this marketplace.

In general, the difficulties with masonry construction lie in two distinct areas. The first is the weakness of the horizontal mortar or bed joints that bond the masonry units together. This weakness is the result of the low tensile strength of the mortar joints and generally requires mortar joint reinforcement for structural stability. The second difficulty is constructing a wall with consistent and uniform mortar joints that keeps the structure vertical and maintains aesthetics. An uneven mortar joint thickness detracts from the overall appearance of the wall and can effect the overall stability and durability of the masonry construction.

The first difficulty is addressed by well-known devices, such as ladder and truss reinforcements for augmenting the tensile strength of the horizontal mortar joints. These devices greatly reduce cracking that can arise from thermal stresses, and increase lateral flexural strength, elasticity and performance of masonry walls under various stresses.

Exemplary of the above, in a patent to Stephen Priest, Jr., U.S. Pat. No. 903,000 issued Nov. 3, 1908, entitled "Wall Tie," a reinforcing ladder device is taught which is constructed of twisted wires with one side of the ladder device embedded in the outer wythe and the other, in the inner wythe. Similarly, H. Spaight, U.S. Pat. No. 2,300,181 issued Oct. 27, 1942, entitled "Means for Constructing Buildings," teaches a truss-shaped reinforcement device for embedment in either one wythe or in cavity walls in both wythes. More recently, W. Smith in U.S. Pat. No. 3,183,628 issued May 18, 1965, entitled "Masonry Wall Reinforcing Means," describes an improvement of the Spaight invention by teaching truss and ladder reinforcements having grooves or bosses on the parallel side wires to increase the mortar bonding therewith. Placing one of the aforementioned devices in the horizontal mortar joints enhances the tensile strength of the horizontal joints.

Several improvements to masonry wall reinforcement have been made by H&B. In 1976, Hala and Schwalberg of H&B, received U.S. Pat. No. 3,964,226 for an adjustable wall-tie reinforcing system which joined reinforcements in inner and outer wythes with an attached eye and pintle structure. During the period when the Uniform Building Code developed joint reinforcement specifications, Hohmann et al., received U.S. Pat. No. 5,454,200 issued Oct. 3, 1995 and U.S. Pat. No. 6,279,283 issued Aug. 28, 2001. These patents provide veneer anchoring systems for masonry walls which include reinforcement for cavity walls. These devices have received widespread usage in the industry. However, none of these devices were designed to aid in the application of uniformly thick mortar joints.

In the past, builders inserted devices between the block, stone or similar masonry building material to align and space the mortar joints. Representative patents include: U.S. Pat. No. 2,172,816—A. Douglas and V. Lefebure—Issued Sep. 12, 1939, entitled "Construction of Walls, Partitions, and the Like," which describes a method of aligning specially-slotted or grooved building blocks using T-shaped dowel plates to tie three adjacent blocks; U.S. Pat. No. 4,334,397—G. Hitz—Issued Jun. 15, 1982, entitled "Masonry Structure and Apparatus and Process for Spacing Block in the Structure," which describes a plastic-pronged spacer that separates the blocks; and U.S. Pat. No. 5,351,457—W. Colen—Issued Oct. 4, 1994, entitled "Wall Construction and Spacer for Use Therewith," which describes wall construction spacers for use in various blocks that tie two adjacent blocks together.

Each of the aforementioned devices addresses either reinforcement or spacing. Additionally, more recent technical advances have resulted in several combination reinforcing and spacing devices, described below. However, these devices do not provide a combination unit for both the reinforcing of the horizontal mortar joints and the spacing of the horizontal and vertical mortar joints.

In preparing for this application the below-mentioned patents have become known to the inventors hereof.

| Patent | Inventor | Issue Date |
|---|---|---|
| 6,629,393 | Pignataro | Oct. 7, 2003 |
| 6,553,737 | Berg | Apr. 29, 2003 |
| 6,279,283 | Hohmann et al. | Aug. 28, 2001 |
| 5,454,200 | Hohmann et al. | Oct. 3, 1995 |
| 5,351,457 | Colen | Oct. 4, 1994 |
| 5,259,161 | Carter | Nov. 9, 1991 |
| 4,689,931 | Hodges | Sep. 1, 1987 |
| 4,334,397 | Hitz | Jun. 15, 1982 |
| 3,964,226 | Hala et al. | Jun. 22, 1976 |
| 3,183,628 | Smith | May 18, 1965 |
| 2,300,181 | Spaight | Oct. 27, 1942 |
| 2,172,816 | Douglas et al. | Sep. 3, 1939 |
| 903,000 | Priest | Nov. 3, 1908 |

-continued

| Patent | Inventor | Issue Date |
|---|---|---|

Of these patents, those not previously discussed, are discussed hereinbelow.

Inventions to properly space masonry building materials are described in patents such as P. Hodges in U.S. Pat. No. 4,689,931 issued Sep. 1, 1987, entitled "Masonry Construction Device," and T. Berg in U.S. Pat. No. 6,553,737 issued Apr. 29, 2003, entitled "Method and apparatus to achieve consistent spacing between layers of modular construction material."

Hodges describes a squared "U" shaped device with a straight bridging member connected between parallel sawtooth shaped members. Upon connecting adjacent ones of Hodges devices, the bridging members thereof form supports for the next course of masonry materials and thereby spaces consecutive courses. The "U" shaped devices are short and manually chained together to cover horizontally adjacent bricks. Berg teaches a device with spacer studs connected to the parallel and transverse rails of a ladder-type reinforcement. The device is placed on the top surface of a brick or block to space the horizontal mortar joint. Along a similar path, F. Carter in U.S. Pat. No. 5,259,161 issued Nov. 9, 1991, entitled "Vertical and horizontal reinforcement and spacing guide for panels constructed of blocks," teaches, specifically for glass block installation, a grid formed by detailed thick elongate reinforcement members of uniform thickness with both horizontal and vertical components.

Horizontal reinforcement and spacing is further taught in J. Pignataro in U.S. Pat. No. 6,629,393 issued Oct. 7, 2003, entitled "Masonry reinforcing tie." Pignataro describes a ladder-type device formed of wire or rod with the parallel elongate members containing integrally formed, spacing elements. The patent describes providing lateral reinforcement and teaches only consistent horizontal mortar joint thickness in a masonry wall. Pignataro further teaches the use of roller dies to form the spacing elements.

Accordingly, while several distinct devices were developed to assist in properly constructing a masonry wall unit, the current state of the art does not fulfill the need for a single efficient and economical combination device that simultaneously reinforces and spaces brick, block, stone or similar masonry building materials. As described hereinbelow, the present invention utilizes a combination reinforcing spacer device to horizontally reinforce and dually space both horizontally and vertically, thereby providing a useful and novel solution to the aforementioned difficulties.

SUMMARY

The present invention is constructed from a rigid material such as steel or a high strength polymeric material and includes parallel side rods with connecting intermediate rods. The embedment of the side rods in the horizontal mortar joint of a masonry wall structure increases the tensile strength of the horizontal mortar joint and provides reinforcement of the masonry wall structure.

The intermediate rods are set at predetermined distances to establish spacing between horizontally-adjacent bricks, blocks, stones or other similar masonry material. Vertical spacing nodes are disposed on the intermediate rods and embedded in the vertical mortar joints to control spacing and the vertical mortar joint thickness. The reinforcing spacer also includes horizontal spacing nodes disposed on the side rods which are embedded in the horizontal mortar joints. The horizontal spacing nodes control the horizontal mortar thickness. The vertical and horizontal spacing nodes are also constructed from a rigid material such as steel, or a high strength polymeric material, and can be affixed to, attached to, or formed from the intermediate rods and side rods.

In general terms, a reinforcing spacer device for a masonry structure is disclosed hereby, which device includes parallel side rods with horizontal spacing nodes and connecting intermediate rods with vertical spacing nodes. The use of the disclosed device provides a novel resource for spacing masonry building materials and further, upon embedment in the mortar beds and joints, increasing the tensile strength of a masonry structure through horizontal mortar joint reinforcement. As described hereinbelow, the present invention utilizes a combination reinforcing spacer device to horizontally reinforce and dually space both horizontally and vertically, thereby providing a useful and novel solution to the aforementioned difficulties.

BRIEF DESCRIPTION OF THE DRAWINGS

In the following drawing, the same parts in the various views are afforded the same reference designators.

DETAILED DESCRIPTION OF THE DRAWINGS

Figure 1:
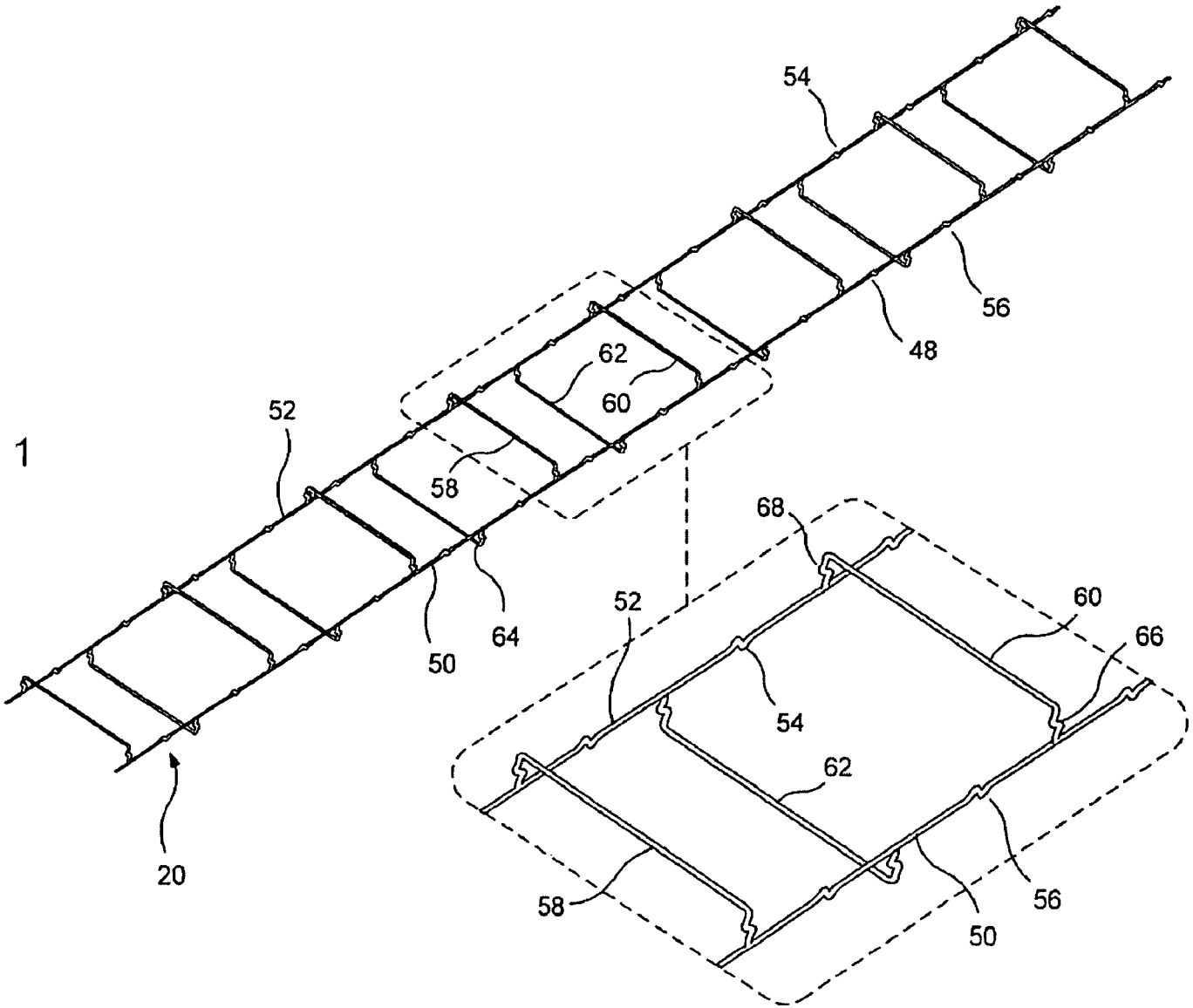
FIG. 1 is a perspective view of a first embodiment of this invention showing a reinforcing spacer with horizontal spacing nodes and vertical spacing nodes formed from the side and intermediate bars.

In the embodiments described hereinbelow, the reinforcing spacer device of this invention combines spacing elements with a reinforcement device. The result of such design produces an economical, combination device that improves the productivity of the mason and the overall quality of masonry construction.

In masonry construction, shown in the embodiments hereof, utilizing this reinforcing spacer device results in a solid, effective reinforced structure and improves the overall tensile strength of the mortar bed. Further, improvement is experienced as this reinforcing spacer device provides uniform spacing of both the horizontal and vertical masonry elements. Such device contributes to the masonry construction field by lowering production costs and improving the strength of masonry walls. To address this need to simultaneously reinforce and space, the inventor's innovative reinforcing spacer device employs a unique structure with spacing elements.

Referring now to FIGS. 1 to 4, the first embodiment of a masonry construction utilizing a reinforcing spacer device of this invention is shown and is referred to generally by the numeral 20. In this embodiment, a masonry wall structure 22 is shown having successive courses of blocks or concrete masonry units ("CMUs") 24, and 26. Typically, each CMU is produced in accordance with ASTM C90 and has nominal dimensions of 4, 6, 8, 10, and 12 inches in width, 4 and 8 inches in height, and 8 and 16 inches in length. Actual dimensions are ⅜ inch smaller than nominal to provide space for vertical and horizontal mortar joints. Other unit heights, lengths, and thicknesses may be available. In the description that follows, the CMU blocks shown in the figures have nominal dimensions of 8×8×16 inches. However, following the teachings of this invention, the reinforcing spacer device can be modified to fit other dimensioned CMUs.

In the first embodiment, a horizontal mortar joint 30 is formed between successive courses of blocks 24 and 26 and the horizontal mortar bed joint 30 is substantially planar and horizontally disposed with any further horizontal bed joints within the masonry wall structure 22. Further, a vertical mortar joint 38 is formed between horizontally adjacent blocks 34 and 35 and a vertical mortar joint 40 is formed between horizontally adjacent blocks 35 and 36.

Figure 2:
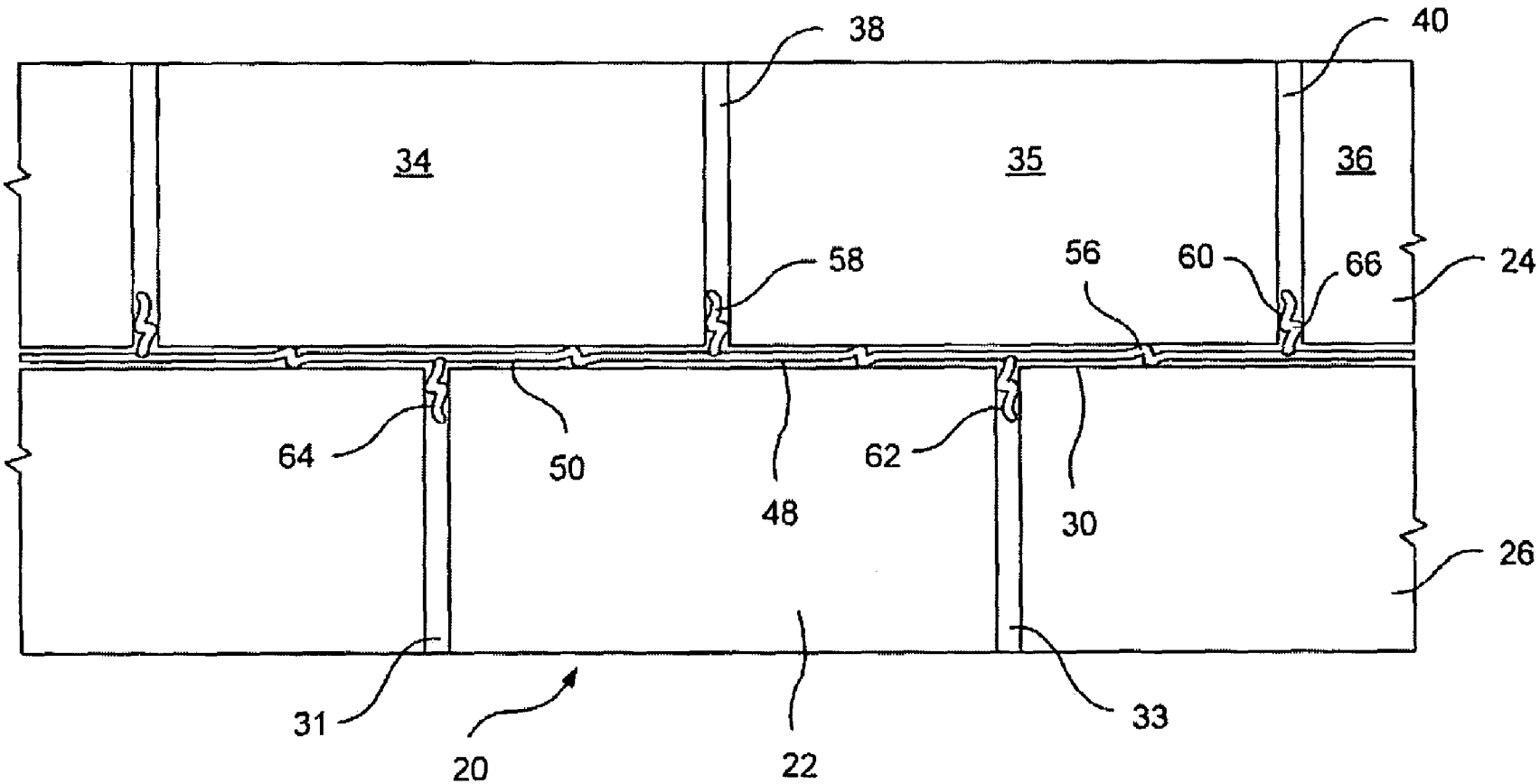
FIG. 2 is a side view of the reinforcing spacer of FIG. 1 showing the reinforcing spacer emplaced on a course of masonry blocks.
Figure 3:
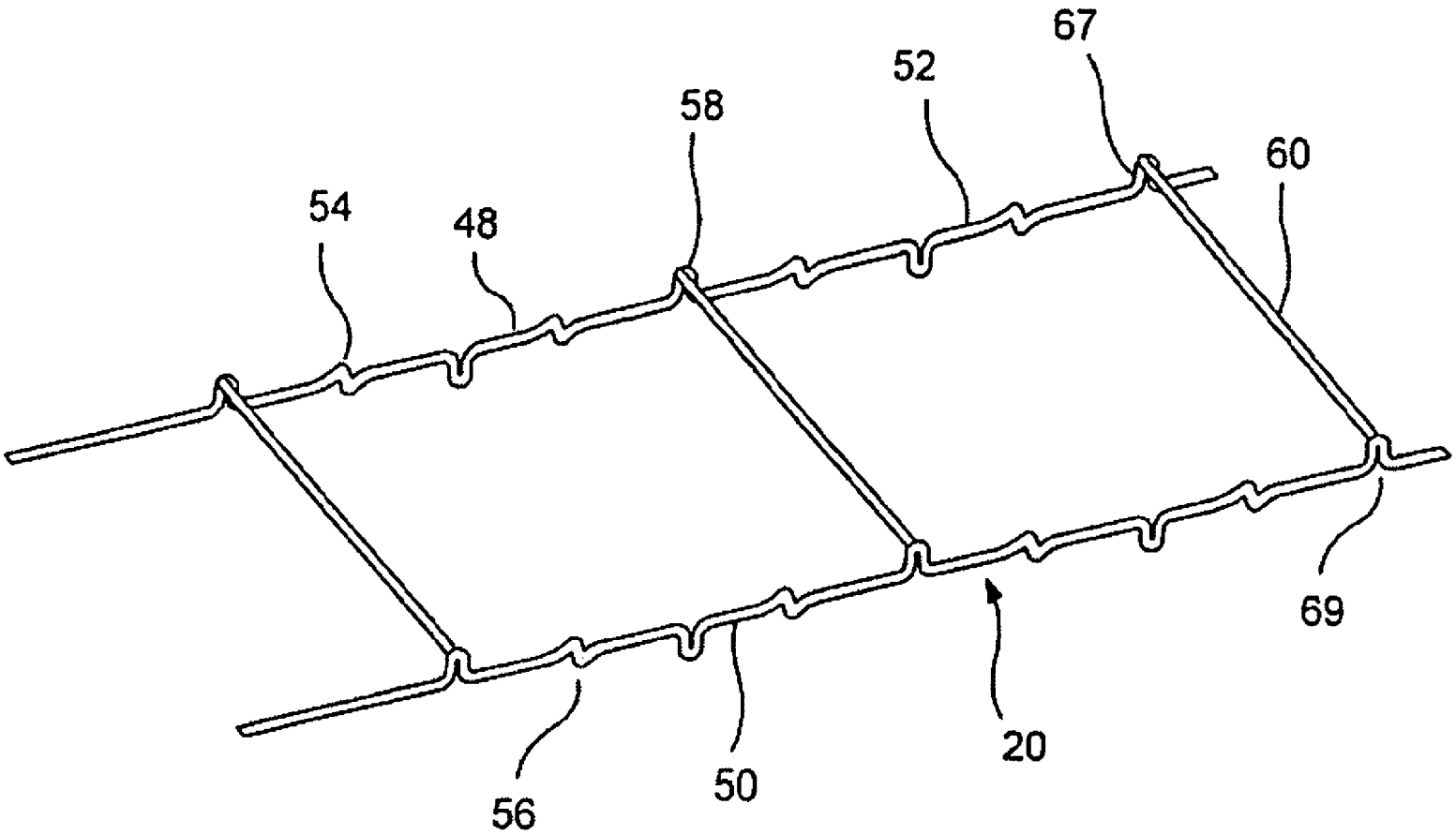
FIG. 3 is a perspective view of an alternative design of the first embodiment of this invention showing a reinforcing spacer with horizontal spacing nodes and vertical spacing nodes formed from the side and intermediate bars.
Figure 4:
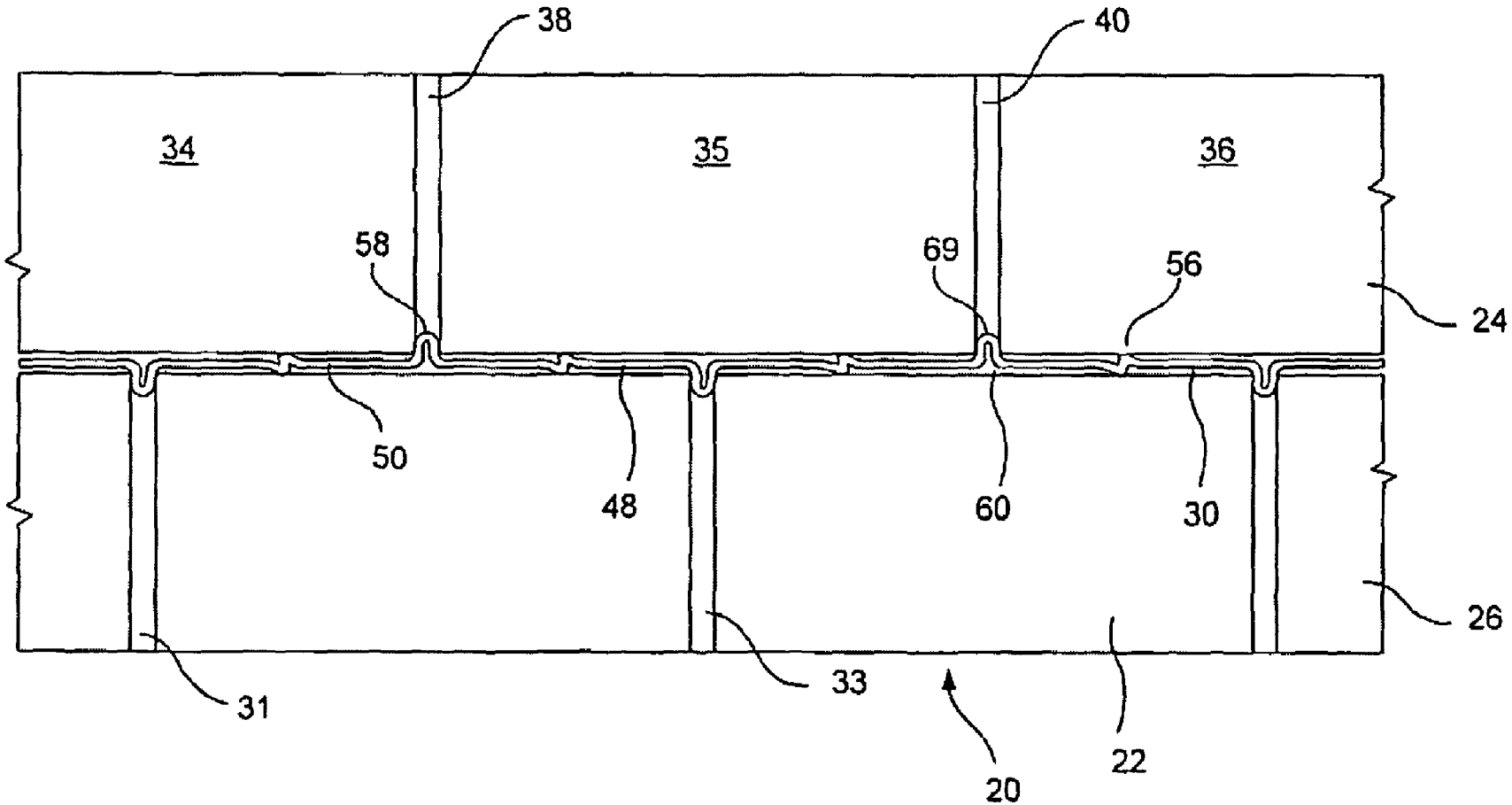
FIG. 4 is a side view of the reinforcing spacer of FIG. 3 showing the reinforcing spacer emplaced on a course of masonry blocks.

The reinforcing spacer device 48 is ladder-like in shape and is constructed with two parallel side rods 50 and 52 spaced so that, upon installation, each is centered along the CMU face shells. Intermediate rods 60 and 62 are interposed therebetween and connect side rods 50 and 52 in a coplanar parallel manner and are centered on the CMU web, which connects the face shells, for embedment in the vertical mortar joints. The reinforcing spacer 48 is constructed with a pair of parallel side rods 50 and 52 with horizontal spacing nodes 54 and 56 formed therefrom using rolling, stamping or other similar method, and constructed for embedment in the horizontal mortar joint 30. The horizontal spacing nodes 54 and 56 are shown in FIGS. 1-4 as waves but can take any shape that would properly space the horizontal mortar joint 30. Also, as shown in FIGS. 1 and 2, a series of intermediate rods 58, 60, 62 and 64 are interposed therebetween and connect the side rods 50 and 52 and are constructed with vertical spacing nodes 66 and 68 for embedment in the vertical mortar joint 40. In FIGS. 3 and 4, because the vertical spacing nodes 67 and 69 are U-shaped, intermediate rods 58 and 60 are not required to connect at each vertical node location. The intermediate rods 58 and 60 and 62 and 64 are constructed in a paired manner to, upon disposition on a course of CMUs 24 and 26, either ascend vertically upward 58 and 60 or downward 62 and 64 into the vertical mortar joints 38 and 40 and 31 and 33, respectively.

The vertical spacing nodes 66 and 68, shown in FIGS. 1 and 2, are generally wave shaped and are formed from the intermediate rod 60. The vertical spacing nodes 66 and 68 have a width substantially equal to the thickness of the vertical mortar joint 40 in order to center the intermediate rod 60 within the vertical mortar joint 40 and to control the vertical mortar joint 40 thickness. The vertical spacing nodes 67 and 69, shown in FIGS. 3 and 4, are generally U-shaped and are formed from the side rods 50 and 52 and connected by intermediate rod 60. The vertical spacing nodes 67 and 69 have a width substantially equal to the thickness of the vertical mortar joint 40 in order to center the intermediate rod 60 within the vertical mortar joint 40 and to control the vertical mortar joint 40 thickness. Such thickness specification is rigorously adhered to so as to provide the uniformity inherent in quality construction. Upon completion of construction, the vertical mortar joint 40 will contain a vertically upward intermediate rod 60 and vertical spacing node 66 or in the case of FIGS. 3 and 4 either a vertically upward intermediate rod 60 and vertical spacing node 69 or just a vertical spacing node 69. Additionally, the vertical mortar joint 40 will also contain a vertically downward intermediate rod and node or just a vertical spacing node to complete proper spacing.

The horizontal spacing nodes 54 and 56 are generally wave shaped and formed from each side rod 50 and 52 at predetermined intervals. The horizontal spacing nodes 54 and 56 have a height substantially equal to the thickness of the horizontal mortar joint 30 to center the side rods in the horizontal mortar joint 30 and to set the horizontal mortar joint thickness, such thickness specification is rigorously adhered to so as to provide the uniformity inherent in quality construction.

Figure 5:
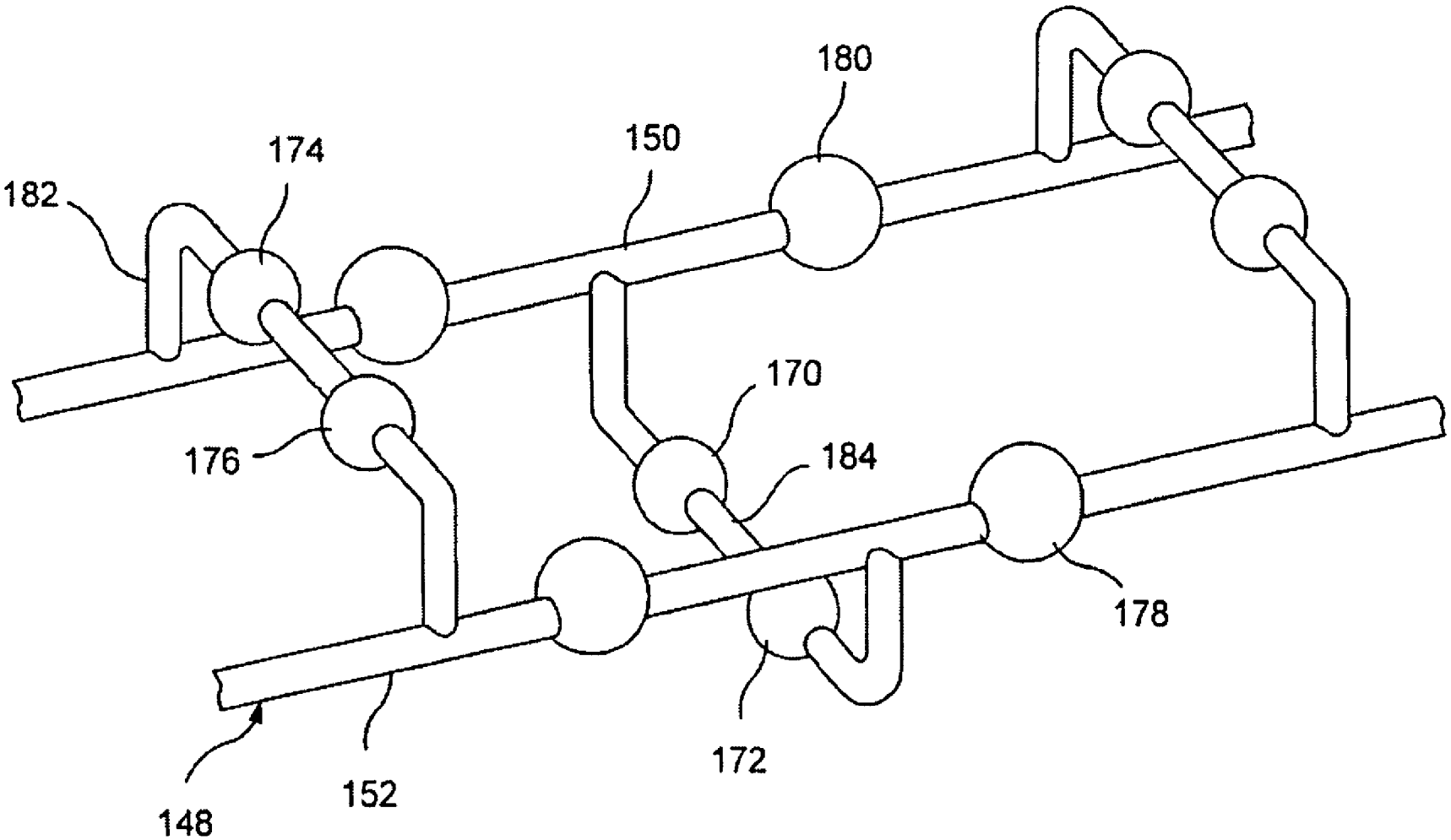
FIG. 5 is a perspective view of a second embodiment of this invention, similar to FIG. 1, but employing horizontal and vertical spacing nodes integral with the side and intermediate rods.

The description that follows is of a second embodiment of the reinforcing spacer device. For ease of comprehension, where similar parts are used, reference designators "100" units higher are employed. Thus, the reinforcing spacer 148 of the second embodiment is analogous to the reinforcing spacer 48 of the first embodiment. Referring now to FIG. 5, the reinforcing spacer device 148 is constructed with a pair of parallel side rods 150 and 152 with horizontal spacing nodes 178 and 180 affixed thereto for embedment in the horizontal mortar joints. A series of intermediate rods 182 and 184 connect the side rods 150 and 152, said intermediate rods 182 and 184 having vertical spacing nodes 170, 172, 174 and 176 affixed thereto and constructed for embedment in the vertical mortar joints.

The reinforcing spacer device 148 is ladder-like in shape. The reinforcing spacer device 148 is constructed with two parallel side rods 150 and 152 spaced so as, upon installation, each is centered along the CMU face shells. Intermediate rods 182 and 184 are interposed therebetween and connect side rods 150 and 152 in a coplanar parallel manner and are centered on the CMU web, which connects the face shells, for embedment in the vertical mortar joints. The intermediate rods also serve as a medium to affix the vertical spacing nodes 170, 172, 174 and 176 which space the horizontal mortar joints. The vertical spacing nodes 170, 172, 174 and 176 are generally bead shaped and affixed to each intermediate rod 182 and 184 in set apart pairs. However, a single vertical spacing node or additional vertical spacing nodes may be used. The vertical spacing nodes 170, 172, 174 and 176 have a diameter substantially equal to the thickness of the vertical mortar joints to center the intermediate rods within the vertical mortar joints and to control the vertical mortar joint thickness, such thickness specification is rigorously adhered to so as to provide the uniformity inherent in quality construction.

The horizontal spacing nodes 178 and 180 are generally bead shaped and affixed to each side rod 150 and 152 at predetermined intervals. The horizontal spacing nodes 178 and 180 have a diameter substantially equal to the thickness of the horizontal mortar joints to center the side rods within the horizontal mortar joints and to set the horizontal mortar joint thickness. Such thickness specification is rigorously adhered to so as to provide the uniformity inherent in quality construction.

Figure 6:
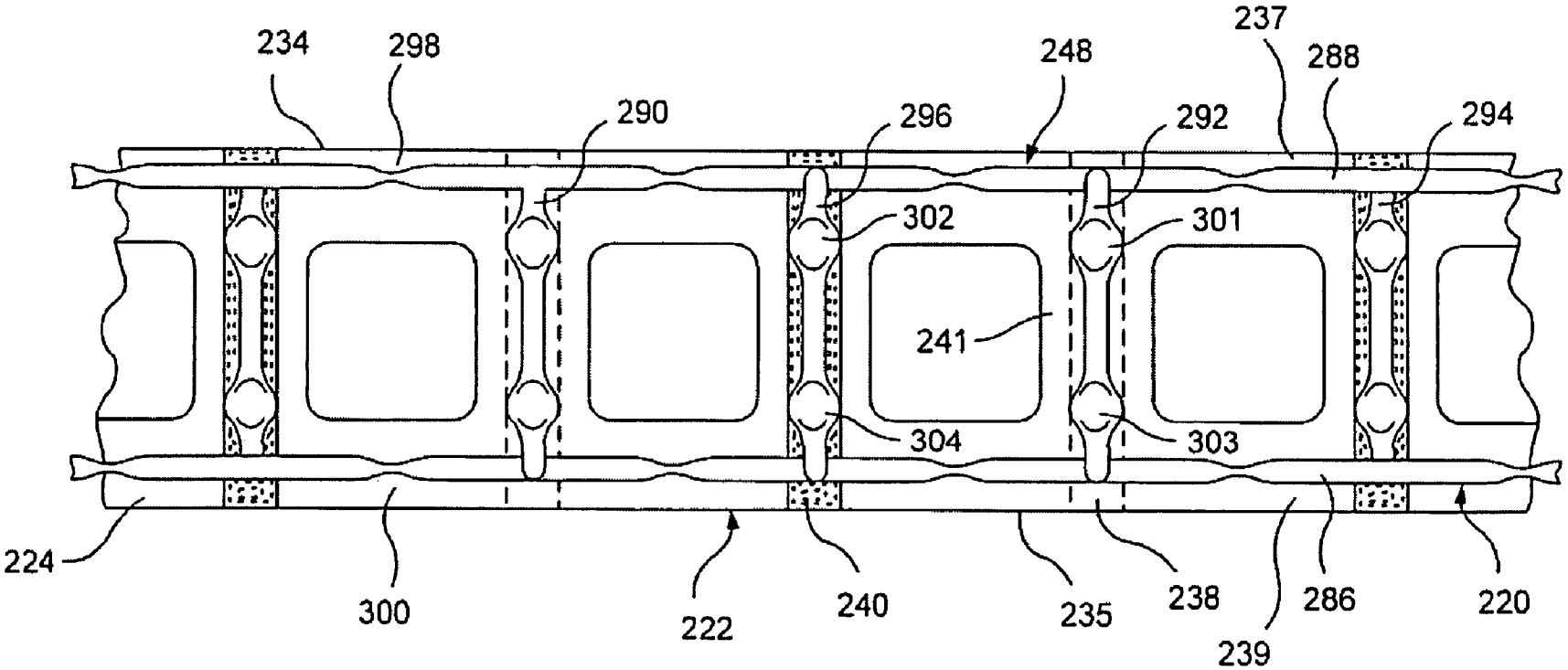
FIG. 6 is a top plan view of a third embodiment of this invention employing horizontal spacing nodes integrally formed from the side rods and vertical spacing nodes integrally formed from the intermediate rods, emplaced on a course of masonry blocks.

The description that follows is of a third embodiment of the reinforcing spacer device. For ease of comprehension, where similar parts are used, reference designators "200" units higher are employed. Thus, the reinforcing spacer device 248 of the third embodiment is analogous to the reinforcing spacer device 48 of the first embodiment and 148 of the second embodiment. Referring now to FIG. 6, in this third embodiment, a masonry wall structure 222 is shown having a course of blocks or CMUs 224 with a vertical mortar joint 240 formed between horizontally adjacent CMUs 234 and 235. The reinforcing spacer 248 is constructed with a pair of parallel side rods 286 and 288 with horizontal spacing nodes 298 and 300 formed therefrom and constructed for embedment in the horizontal mortar joints and a series of intermediate rods 290, 292, 294 and 296 connecting the side rods 286 and 288. Said intermediate rod 296 with vertical spacing nodes 302 and 304 constructed for embedment in the vertical mortar joint 240.

The reinforcing spacer device 248 is ladder-like in shape and shown in FIG. 6 as being placed on a course of CMUs 224 in preparation for embedment in the horizontal mortar joints and vertical mortar joints 238 and 240. A reinforcing spacer 248 is constructed with two parallel side rods 286 and 288 spaced so as, upon installation, each is centered along the CMU face shells 237 and 239. Intermediate rods 290, 292, 294 and 296 are interposed therebetween and connect side rods 286 and 288 in a parallel manner and centered on the CMU web 241, which connects the face shells, for embedment in the vertical mortar joints 238 and 240.

The intermediate rods are constructed in a paired manner to, upon disposition on a course of CMUs 224 and 226, either ascend vertically upward 292 or downward 296 into the vertical mortar joints 238 and 240, respectively, so as to provide a medium to form the vertical spacing nodes 301 and 303 and 302 and 304 which horizontally space the CMUs. The vertical spacing nodes 302 and 304 are generally disc shaped and formed by compressing each intermediate rod 296. The vertical spacing nodes 302 and 304 each have a diameter substantially equal to the thickness of the vertical mortar joint 240 to center the intermediate rods and to control the vertical mortar joint thickness. Such thickness specification is rigorously adhered to so as to provide the uniformity inherent in quality construction. Upon completion of construction, each vertical mortar joint 238 will contain a vertically upward intermediate rod 292 and a vertically downward intermediate rod (not shown), with each intermediate rod 292 having a pair of vertical spacing nodes 301 and 303 formed therefrom. However, a single vertical spacing node or additional vertical spacing nodes may be used.

The horizontal spacing nodes 298 and 300 are generally disc shaped and formed by compressing each side rod 286 and 288 set at predetermined intervals. The horizontal spacing nodes 298 and 300 each have a diameter substantially equal to the thickness of the horizontal mortar joints to center the side rods within the horizontal mortar joint and to set the horizontal mortar joint thickness. Such thickness specification is rigorously adhered to so as to provide the uniformity inherent in quality construction.

Figure 7:
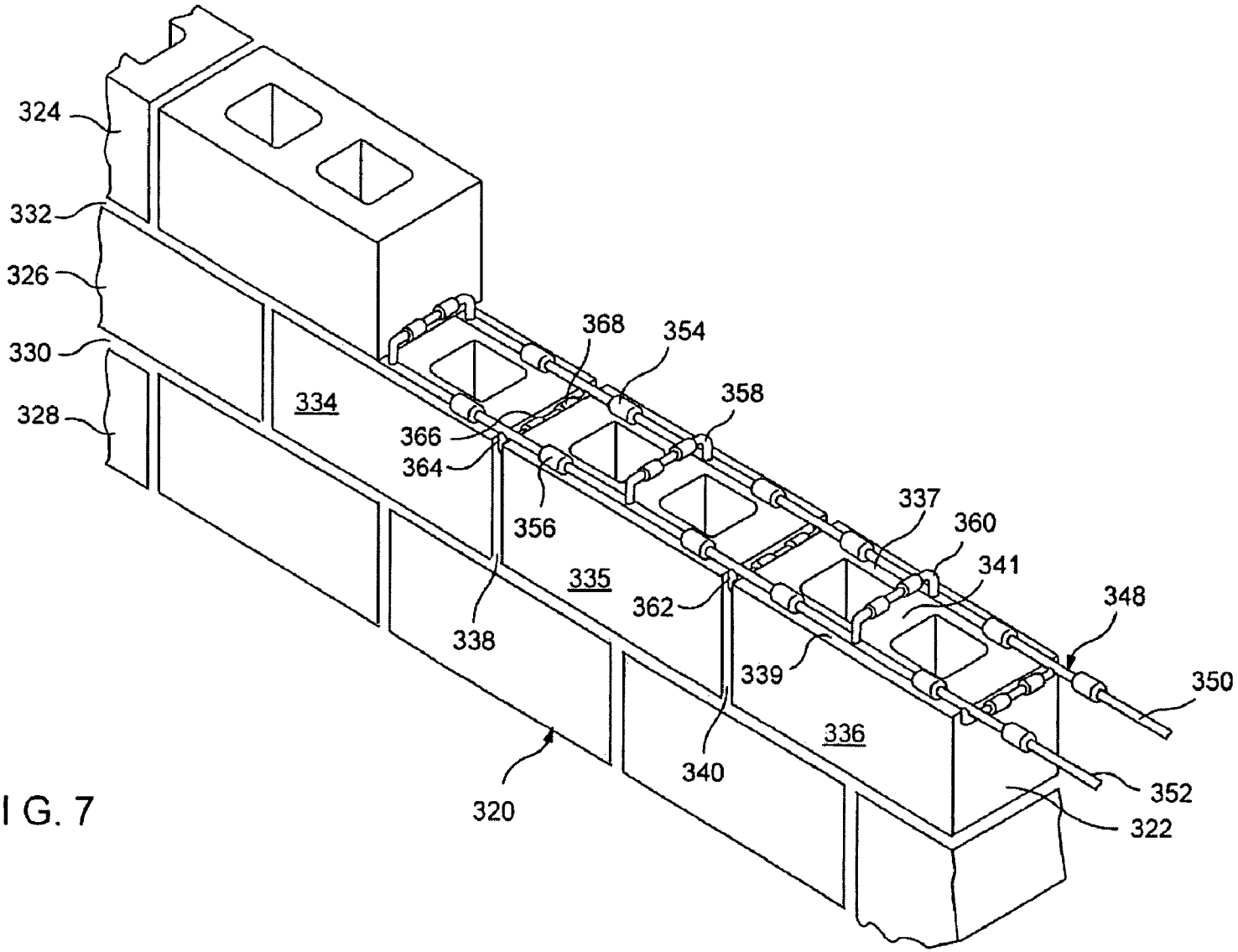
FIG. 7 is a perspective view of a fourth embodiment of this invention showing a reinforcing spacer with horizontal spacing nodes and vertical spacing nodes attached thereto, embedded in a masonry wall unit.
Figure 8:
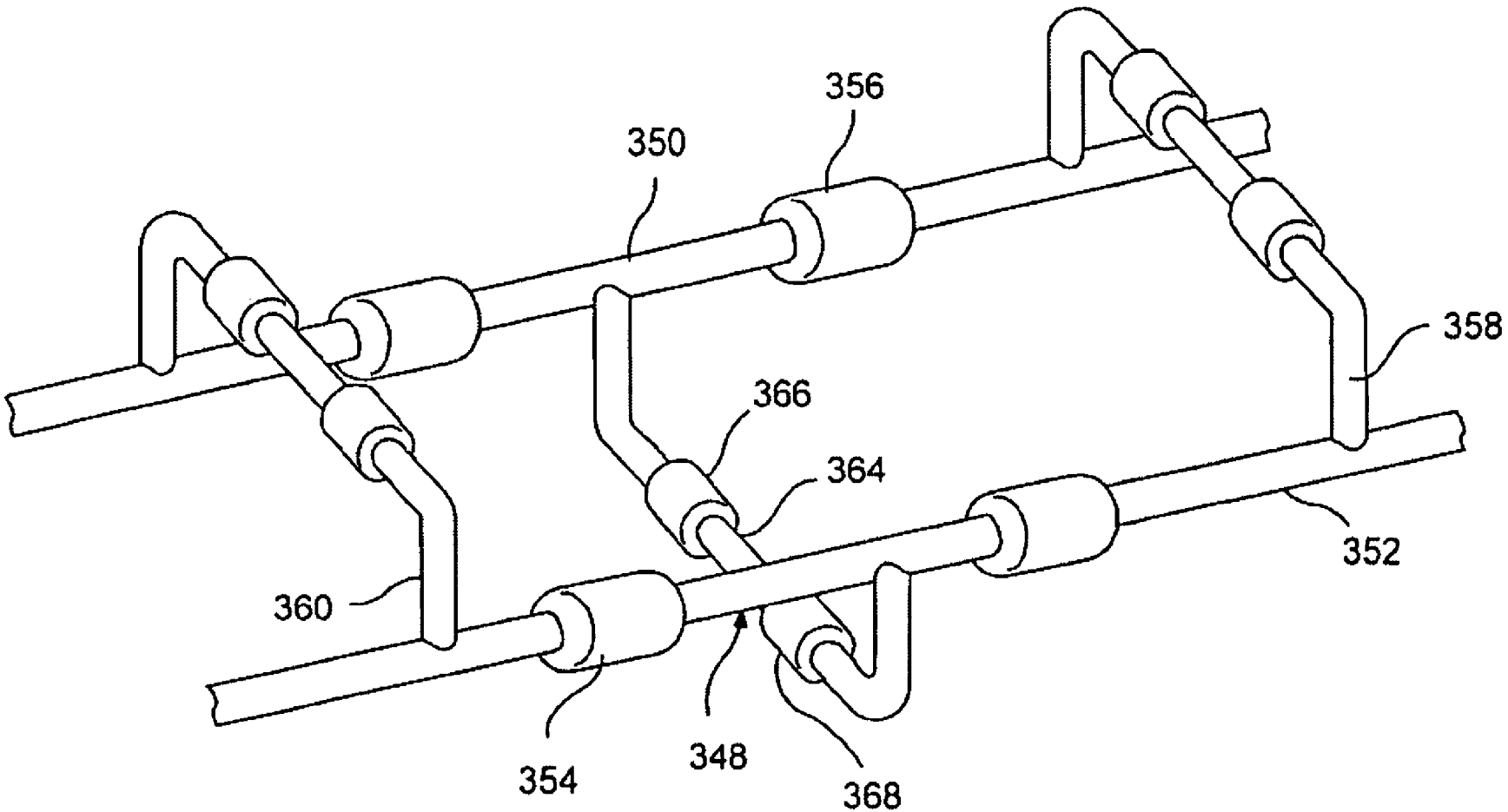
FIG. 8 is a perspective view of the reinforcing spacer of FIG. 7 showing the vertical and horizontal spacing nodes attached to the intermediate and side bars.
Figure 9:
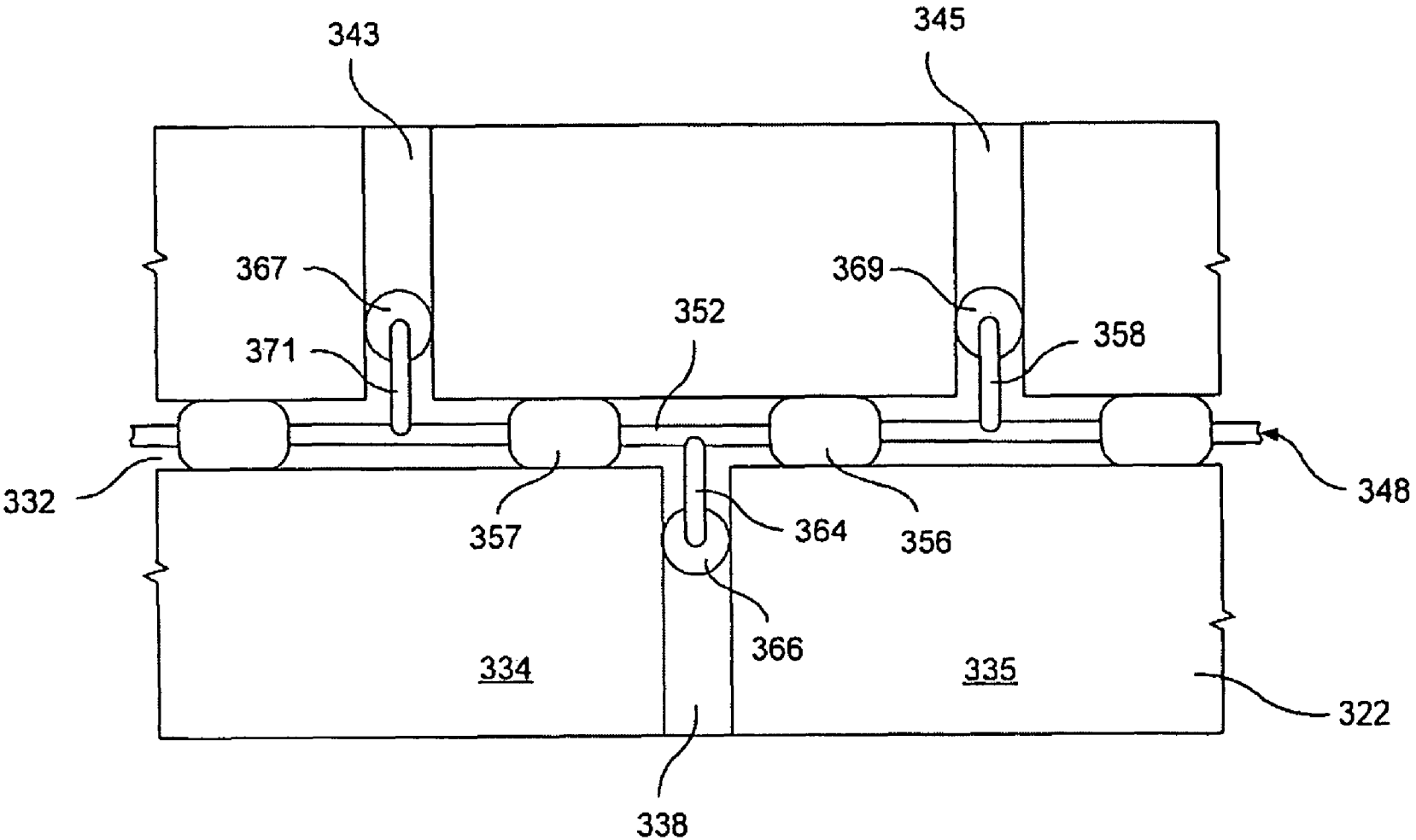
FIG. 9 is a side view of the reinforcing spacer of FIG. 7 with dashed lines representing the placement of the concrete masonry units.

The description that follows is of a fourth embodiment of the reinforcing spacer device. For ease of comprehension, where similar parts are used, reference designators "300" units higher are employed. Thus, the reinforcing spacer device 348 of the fourth embodiment is analogous to the reinforcing spacer device 48 of the first embodiment. Referring now to FIGS. 7 to 9, the first embodiment of a masonry construction utilizing a reinforcing spacer device of this invention is shown and is referred to generally by the numeral 320. In this embodiment, a masonry wall structure 322 is shown having successive courses of blocks or CMUs 324, 326 and 328.

In the first embodiment, successive horizontal mortar joints 330 and 332 are formed between successive courses of blocks 324, 326 and 328 and the horizontal mortar bed joints 330 and 332 are substantially planar and horizontally disposed. Further, a vertical mortar joint 338 is formed between horizontally adjacent blocks 334 and 335 and a vertical mortar joint 340 is formed between horizontally adjacent blocks 335 and 336.

The reinforcing spacer 348 is constructed with a pair of parallel side rods 350 and 352 with horizontal spacing nodes 354 and 356 attached thereto and constructed for embedment in the horizontal mortar joint 332. Also, a series of intermediate rods 358, 360, 362 and 364 connect the side rods 350 and 352 and are constructed with vertical spacing nodes 366 and 368 for embedment in the vertical mortar joint 338.

The reinforcing spacer 348 is ladder-like in shape and is shown in FIG. 7 as being placed on a course of blocks 326 in preparation for embedment in the horizontal mortar joint 332 and vertical mortar joints 338 and 340. In the best mode of practicing the invention, a reinforcing spacer device 348 is constructed with two parallel side rods 350 and 352 spaced so as, upon installation, each is centered along the CMU face shells 337 and 339. Intermediate rods 358, 360, 362 and 364 are interposed therebetween and connect side rods 350 and 352 in a parallel manner and embed in the vertical mortar joints 338 and 340.

The intermediate rods 358 and 371 and 362 and 364 are constructed in a paired manner to, upon disposition on a course of CMUs 324 and 326, either ascend vertically upward 358 and 371 or downward 362 and 364 into the vertical mortar joints 343 and 345 and 338 and 340, respectively. The intermediate rod 358 is centered on the CMU web 341, which connects the face shells 337 and 339, to embed in vertical mortar joints of a course of CMUs 326. The intermediate rod 364 provides a medium to attach the vertical spacing nodes 366 and 368. Such vertical spacing nodes 366 and 368 horizontally space the vertical mortar joint 338, providing precision spacing and assisting the mason in constructing a quality masonry wall structure.

The vertical spacing nodes 366 and 368 are generally cylindrically shaped in a collar manner to attach to an intermediate rod 364 in a set apart pair. However, a single vertical spacing node or additional vertical spacing nodes may be used. The vertical spacing nodes 366 and 368 have a width substantially equal to the thickness of the vertical mortar joint 338 in order to center the intermediate rod 364 within the vertical mortar joint 338 and to control the vertical mortar joint 338 thickness. Such thickness specification is rigorously adhered to so as to provide the uniformity inherent in quality construction. Upon completion of construction, the vertical mortar joint 343 will contain a vertically upward intermediate rod 371 and a vertically downward intermediate rod (not shown) with each intermediate rod having vertical spacing nodes 367 attached thereto. When the reinforcing spacer device 348 is set in a masonry wall structure 322, as shown in FIG. 9, the side bar 352 reinforces the horizontal mortar bed 332 and along with the attached intermediate rods 358, 364, and 371 and the addition of horizontal spacing nodes 356 and 357 and vertical spacing nodes 366, 367 and 369, sets the proper spacing of the horizontal mortar bed 332 and vertical mortar joints 338, 343 and 345.

The horizontal spacing nodes 354 and 356 are generally cylindrically shaped in a collar manner to attach to each side rod 350 and 352 at predetermined intervals. The horizontal spacing nodes 354 and 356 have a height substantially equal to the thickness of the horizontal mortar joint 332 to center the side rods in the horizontal mortar joint 332 and to set the horizontal mortar joint thickness, such thickness specification is rigorously adhered to so as to provide the uniformity inherent in quality construction.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed is:

1. A reinforcing spacer for use in a masonry wall structure formed from successive courses of brick, block, stone or similar masonry building material, said courses having between each two adjacent courses a horizontal mortar joint of predetermined height and a vertical mortar joint of predetermined width between horizontally adjacent said brick, block, stone or similar masonry building material, said reinforcing spacer comprising:

a pair of side rods parallel to one another;

a plurality of horizontal spacing nodes disposed at predetermined intervals on upper and lower surfaces of said side rods, said side rods having horizontal spacing nodes disposed thereon and adapted for embedment in said horizontal mortar joint upon installation;

a series of intermediate rods connecting said side rods and maintaining the parallelism of said side rods, said intermediate rods adapted for embedment in said vertical mortar joint to establish spacing of said brick, block, stone or similar masonry building material in the respective courses thereof upon installation; and a plurality of vertical spacing nodes disposed at predetermined intervals on one of said side rods and said intermediate rods;

wherein said horizontal and vertical spacing nodes are formed from said side rods, first pairs of the vertical nodes being arranged in opposed relation on the side rods and projecting from the side rods in a first direction, second pairs of the vertical nodes being arranged in opposed relation on the side rods and projecting from the side rods in a second direction opposite the first direction, the first pairs of vertical nodes alternating with the second pairs of vertical nodes along the lengths of the side rods, and wherein the intermediate rods extend between the side rods between the first pairs of vertical nodes and no intermediate rods extend between the side rods between the second pair of vertical nodes.

2. A reinforcing spacer as described in claim 1, wherein said side rods and said intermediate rods are constructed of material selected from a group consisting of galvanized steel, hot-dip galvanized steel, stainless steel, bright basic steel and high-strength polymeric material.

3. A reinforcing spacer as described in claim 1, wherein said horizontal and vertical spacing nodes are constructed of material selected from a group consisting of galvanized steel, hot-dip galvanized steel, stainless steel, bright basic steel and high-strength polymeric material.

4. A reinforcing spacer as described in claim 1, wherein said vertical spacing nodes are affixed to said intermediate rods.

* * * * *